US006846602B2

(12) United States Patent
Suwa et al.

(10) Patent No.: US 6,846,602 B2
(45) Date of Patent: Jan. 25, 2005

(54) FULL-COLOR TONER FOR OIL-LESS FIXING

(75) Inventors: Yoshihito Suwa, Shizuoka (JP); Toru Nakamura, Abiko (JP)

(73) Assignees: Tomoegawa Paper Co., Ltd., Tokyo (JP); Ticona GmbH (DE)

( * ) Notice: Subject to any disclaimer, the term of this patent is extended or adjusted under 35 U.S.C. 154(b) by 10 days.

(21) Appl. No.: 10/264,837

(22) Filed: Oct. 4, 2002

(65) Prior Publication Data

US 2003/0118930 A1 Jun. 26, 2003

(30) Foreign Application Priority Data

Oct. 5, 2001 (JP) ..... P2001-309468

(51) Int. Cl.[7] ..... G03G 9/087

(52) U.S. Cl. ..... 430/108.4; 430/108.8; 430/109.3

(58) Field of Search ..... 430/108.4, 108.8, 430/109.3

(56) References Cited

U.S. PATENT DOCUMENTS

| | | | | |
|---|---|---|---|---|
| 6,210,852 | B1 * | 4/2001 | Nakamura | 430/110 |
| 6,287,742 | B1 * | 9/2001 | Yoon | 430/110 |
| 6,524,762 | B2 * | 2/2003 | Tsutsui et al. | 430/108.8 |

FOREIGN PATENT DOCUMENTS

| | | |
|---|---|---|
| EP | 0 978 766 A1 | 2/2000 |
| JP | 05-009223 | 1/1993 |
| JP | 05-339327 | 12/1993 |
| JP | 06-271628 | 9/1994 |
| JP | 09-101631 | 4/1997 |
| JP | 2000-066438 | 3/2000 |
| JP | 2000-206732 | 7/2000 |
| JP | 2000-284528 | 10/2000 |
| WO | WO98/29783 | 7/1998 |
| WO | WO-01/19617 A1 | 3/2001 |

* cited by examiner

*Primary Examiner*—John L Goodrow
(74) *Attorney, Agent, or Firm*—Connolly Bove Lodge & Hutz LLP

(57) ABSTRACT

The object of the present invention is to provide a full-color toner for oil-less fixing that is able to maintain adequate image density over a long period of time in all types of environments even in the case of continuous printing of a large number of sheets, does not result in the occurrence of problems such as black spots (BS) caused by filming on the photosensitive member or fusing to developing members, demonstrates high image quality similar to that of silver halide photographs, namely, adequate glossiness, color mixing property (color reproduction property) and transparency as full-color images for printed images, and is able to demonstrate adequate optical transmittance in OHP images. In order to achieve the object, the present invention provides a full-color toner for oil-less fixing comprising a cyclo-olefin copolymer resin as a binder resin and a wax or waxes added as a release agent at the total weight of 7.0–20% by weight relative to the weight of a toner particle, and having 15 or more of glossiness of a printed image face.

12 Claims, No Drawings

FULL-COLOR TONER FOR OIL-LESS FIXING

BACKGROUND OF THE INVENTION

1. Field of the Invention

The present invention relates to a full-color toner for oil-less fixing suitable for use in an image forming device using electrophotographic technology such as a full-color copier, full-color printer, and so forth that employs oil-less fixing.

2. Description of the Related Art

Dry developers suitable for use in the above image forming devices are roughly classified into two-component developers in which toner is mixed with a carrier such as ferrite powder, iron powder, glass beads, and so forth, magnetic single-component developers in which magnetic powder is comprised in the toner itself, and non-magnetic single-component developers. The toners used for these developers have a binder resin and a colorant as the main components, while also containing a wax for ensuring satisfactory low-temperature fixability to the recording sheet, release agent for preventing offset, charge control agent for imparting polarity (positive charge or negative charge), and so forth. After these materials are mixed at prescribed ratios, the toner is manufactured as a powder after undergoing steps such as melt-kneading, pulverizing and classifying, and finally subjected to surface treatment in which an external additive such as silica, titanium oxide, alumina or various types of resin fine particles is adhered to control fluidity, chargeability, cleaning properties and storage properties, etc. and ultimately provided as the developer.

In the fixing device of these image forming devices, an oil such as silicone oil having satisfactory releasing properties has been coated onto the fixing roller to prevent so-called offset, that is, toner adheres and accumulates on the fixing roller and other fixing members. However, since this method requires an oil tank and oil coating device, the device becomes complex and large. In addition, since this method also causes deterioration of the fixing roller, maintenance is required at fixed intervals. Moreover, since the adherence of oil to copy paper and OHP (overhead projector) film and so forth cannot be avoided, there is the problem of poor color tone due to adherence of oil in the case of OHP film in particular.

In consideration of the above problems, a so-called oil-less type of image forming device has come to be provided in recent years that does not use release oil in the fixing device for the purpose of simplifying maintenance, conserving resources, reducing costs and so forth. Instead of using release oil, measures have generally been employed in which a release agent like wax is added in large amounts within the toner particle or the molten elastic modulus of the binder resin is enhanced by crosslinking or containing high molecular weight components, to supplement the function of the release oil.

In addition, relative to full-color images, there is a considerable demand for photographic, glossinessy images, and in order to respond to this demand, the toner face after fixing is required to be smooth, and the toner must have high transparency. Consequently, it is necessary that the toner have extremely low viscosity at the fixing temperature. However, in order to lower the viscosity of the toner at the fixing temperature extremely low, it is necessary to decrease the molecular weight of the binder resin. However, lowering the molecular weight brings about a decrease in the durability of the resin in the developing device, resulting in the problem of the rapid occurrence of streaked image unevenness, an increased degree of background fogging and so forth.

However, in the case of image forming devices that employ an oil-less fixing system using a type of toner that contains a large amount of release agent as described above, problems such as defective image characteristics due to the occurrence of black spots (BS) due to filming on the photosensitive member or the occurrence of fusing to developing or charging members (developing roller, layer thickness regulating member, etc.) tended to occur easily during the course of printing a large number of sheets. In addition, although expanding the molecular weight distribution of the binder resin or increasing the molten viscosity by crosslinking is effective for solving the above problems, this causes unevenness in melting of the binder resin at the fixing temperature, and carries fatal problems for full-color toners, such as decreased smoothness of the image face, decreased image glossiness, inadequate optical transmittance of OHP images and other.

As described above, the occurrence of BS on the photosensitive member and fusing to the developing or charging members is caused by the addition of a large amount of waxes as release agents in the toner particles. On the other hand, inadequate glossiness of image surfaces and inadequate optical transmittance of OHP images are caused by restricting the amount of waxes added in the toner particles, and expanding of the molecular weight distribution of the binder resin to alleviate the above problems.

As there are also aspects of full-color toners that require high-quality images equivalent to ordinary silver halide photographs, and based on the need for image glossiness, color mixing property (color reproduction property) and transparency, polyester resins having sharp melting characteristics have been used, and waxes have been finely dispersed within a range that prevents the occurrence of BS on the photosensitive member and the occurrence of fusing to developing members and so forth. However, the range of added amount of waxes that solves the both problems is narrow, and the selection is not easily. Therefore, in order to finely disperse a large amount of wax, natural wax and polar wax are commonly used. As polyester resins inherently had poor environmental characteristics, presented difficulties in obtaining a stable charging amount relative to environmental changes such as temperature and humidity, tended to carry exacerbation of background fogging at high temperatures and high humidity and decreased image density at low temperatures and low humidity. Moreover, the use of natural wax or polar wax tended to cause these environmental characteristics to further worse.

SUMMARY OF THE INVENTION

Thus, in order to solve the above problems, the object of the present invention is to provide a full-color toner for oil-less fixing that is able to maintain adequate image density for a long period of time in any environment even during continuous printing of a large number of sheets, that does not cause the problem of the occurrence of BS on the photosensitive member and the fusing to the developing members, that demonstrates high image quality similar to that of silver halide photographs, namely, adequate glossiness, color mixing property (color reproduction property) and transparency in printed images of full-color images, and that is able to exhibit adequate optical transmittance in OHP images.

In order to achieve the object, the present invention provides a full-color toner for oil-less fixing comprising a cyclo-olefin copolymer resin as a binder resin and a wax or waxes added as a release agent at the total weight of 7.0–20% by weight relative to the weight of a toner particle, and having 15 or more of glossiness of a printed image face.

According to the full-color toner for oil-less fixing of the present invention, the full-color toner demonstrates revolutionary effects that is able to maintain adequate image density over a long period of time in all types of temperature (high, normal and low) and humidity (high, normal and low) environments even in the case of continuous printing of a large number of sheets, does not result in the occurrence of problems such as BS on the photosensitive member or fusing to developing members, demonstrates high image quality similar to that of silver halide photographs, namely, adequate glossiness, color mixing property (color reproduction property) and transparency in printed images of full-color images, and is able to exhibit adequate optical transmittance in OHP images.

In the full-color toner of the present invention, it is preferable for hydrophobic silica fine particles to be adhered to the surface of the toner particles at 1.0–4.0% by weight relative to the toner particles.

In the full-color toner of the present invention, it is also preferable for the hydrophobic silica fine particles to comprise large particles having a volume average particle diameter of 0.03–0.10 $\mu$m and medium and small particles having a volume average particle diameter of less than 0.03 $\mu$m.

In the full-color toner of the present invention, it is also preferable for the cyclo-olefin copolymer resin as a binder resin in the toner to have a number average molecular weight (Mn) of 3,000–6,000 as measured by GPC, a weight average molecular weight (Mw) of 9,000–60,000, and the ratio of Mw/Mn is 2.0–15.

In the full-color toner of the present invention, it is also preferable for at least one wax to have a melting point which is indicated with the endothermic peak of DSC of 80–100°C.

In the full-color toner of the present invention, it is also preferable for the at least one of wax to be Fischer-Tropsch wax.

In the full-color toner of the present invention, it is also preferable to contain a compound represented by the following general formula as a charge control agent at 1.0–4.0% by weight relative to the weight of a toner particle:

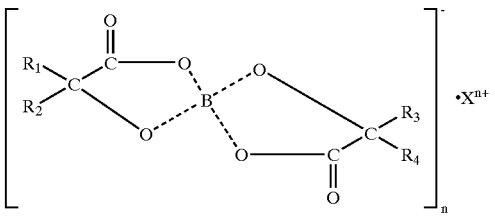

wherein $R_1$ and $R_4$ represent a hydrogen atom, alkyl group or substituted or non-substituted aromatic ring including a condensed ring, $R_2$ and $R_3$ represent a substituted or non-substituted aromatic ring also including a condensed ring, B represents boron, $X^{n+}$ represents a cation, and n is 1 or 2.

In the full-color toner of the present invention, it is also preferable for the concentration of decalin contained in the toner particles to be 500 ppm or less by weight relative to the weight of a toner particle.

DETAILED DESCRIPTION OF THE PREFERRED EMBODIMENTS

The following provides an explanation of the full-color toner for oil-less fixing of the present invention.

The toner of the present invention comprises a binder resin and a release agent. The binder resin is at least a cyclo-olefin copolymer resin, and the release agent is at least a wax. The toner may contain colorant, charge control agent and so forth, and an external additive such as a fluidizing agent is adhered, as necessary.

Binder resin of the present invention comprises a cyclo-olefin copolymer resin. Examples of cyclo-olefin copolymer resins include copolymers of $\alpha$-olefins such as ethylene, propylene and butylene (acyclic olefins in the broad sense) and alicyclic compounds having double bonds such as cyclohexene, norbornene and tetracyclododecene (cyclo-olefins). This cyclo-olefin copolymer resin is a polymer obtained by a polymerization method using a metallocene or Ziegler catalyst. The cyclo-olefin copolymer resin used in the present invention is preferably adequately removed of decalin used as solvent during production. The decalin remaining in the toner is preferably 500 ppm or less relative to the entire amount of toner. If the amount of decalin exceeds 500 ppm, since this is a high boiling point solvent and is easily retained in the toner, it causes problems such as lowering the charge control ability of the toner, increasing susceptibility to the occurrence of background fogging in printed images, and generating an odor during fixing. Moreover, measurement of the residual amount of decalin in toner is carried out by a gas chromatography method.

It is preferable for the main cyclo-olefin copolymer resin to have a number average molecular weight (Mn) as measured by gel permeation chromatography (GPC) of less than 5,000, and preferably 3,500–4,000, and have a weight average molecular weight (Mw) of less than 60,000, and preferably 10,000–50,000, since it allows the obtaining of a practical balance between non-offset temperature range and image glossiness.

In the present invention, the number average molecular weight and the weight average molecular weight were measured by GPC measurement. The GPC measurements were carried out as follows. Tetrahydrofuran (THF) was flowed at a flow rate of 1 ml/min at a column temperature of 40° C., and then a THF solution of sample was injected, and thereby a measured value was obtained. Moreover, polystyrene was used as a standard material, and then the obtained measured value was converted into polystyrene-converted value.

The cyclo-olefin copolymer resin is preferably a single fraction when considering image glossiness only. However, in order to control the non-offset temperature, it preferably contains a small amount of a high molecular weight fraction as necessary. Thus, the cyclo-olefin copolymer resin preferably comprises mainly the above low molecular weight resin while additionally being blended with a high molecular weight resin within the range of 15% or less relative to the total amount of cyclo-olefin copolymer resin.

Selecting the binder resin and adjusting the production conditions so that cyclo-olefin copolymer resin as a binder resin in the toner particles have a number average molecular weight (Mn) as measured by GPC of 3,000–6,000, and a weight average molecular weight (Mw) of 9,000–60,000, and the ratio of Mw/Mn is 2.0–15, is preferable since it allows the obtaining of practical balance between non-offset temperature range and image glossiness. The molecular weight of the binder resin in the toner is important because is determines the quality of the toner in terms of practical use. If the molecular weight of the cyclo-olefin copolymer resin as a binder resin in the toner particles is less than the above range, durability of toner decreases and fusing occurs easily. In contrast, if the molecular weight of the toner particles exceeds the above range, although an adequate non-offset temperature range is obtained, glossiness of the toner face, color mixing property (color reproduction property) and transparency become poor at fixing.

Moreover, molecular weight distribution of the binder resin in the toner is measured by dissolving the toner in THF, taking out binder resin solution by centrifugalization, and carrying out the above-mentioned GPC measurement.

If the ratio of Mw/Mn exceeds the above range, the pulverizing property during toner production becomes poor and also poor image fixing and poor glossiness of the image face, color mixing property (color reproduction property) and transparency of the image surface occur. In contrast, if it is less than the above range, anti hot offsetting properties become poor, and the toner becomes to a fine powder during continuous printing resulting in problems such as increasing background fogging and so forth.

Synthesis examples of the cyclo-olefin copolymer resin used in the present invention are disclosed in, for example, Japanese Unexamined Patent Application, First Publication No. Hei 05-339327, Japanese Unexamined Patent Application, First Publication No. Hei 05-9223 and Japanese Unexamined Patent Application, First Publication No. Hei 06-271628.

In addition, the charged molar ratio of α-olefin and cyclo-olefin can be varied over a wide range, and should be adjusted according to the required characteristics of the purpose of the cyclo-olefin copolymer. The range over which adjustment can be made is 2–98 mol % cyclo-olefin, and preferably 5–95 mol % cyclo-olefin, relative to the total of both. For example, in the case of reacting ethylene as α-olefin and norbornene as cyclo-olefin, the glass transition temperature (Tg) of the product cyclo-olefin copolymer is greatly affected by their charged ratio. If the charged ratio of norbornene is increased, Tg also tends to increase. For example, when the charged ratio of norbornene is set to 60% by weight, Tg becomes roughly 60–70° C.

In addition, compatibility with other resins and pigment dispersibility can be improved by introducing carboxyl groups into the cyclo-olefin copolymer resin by the fusing air oxidation method, maleic anhydride modification or acrylic acid modification and so forth. In addition, similar improvements can also be realized by introducing hydroxyl groups and amino groups by known methods. Moreover, anti-offset properties can be improved by copolymerizing the cyclo-olefin copolymer resin with a diene monomer such as norbornadiene, cyclohexadiene or tetracyclododecadiene, or by introducing a crosslinked structure by adding a metal such as zinc, copper or calcium to the cyclo-olefin copolymer resin into which carboxyl groups have been introduced. However, since this causes a decrease in the glossiness, color mixing property (color reproduction property) and transparency of the printed image, this is not preferable for full-color applications for the purpose of obtaining images similar to that of silver halide photographs.

In the present invention, a cyclo-olefin copolymer resin that satisfies the above characteristics may be used by mixing with other resins as the binder resin. In this case, the blending ratio of cyclo-olefin copolymer resin and other resins is preferably such that the cyclo-olefin copolymer resin is 50–100% by weight, and more preferably 80–100% by weight, within the total amount of cyclo-olefin copolymer resin and other resins. If the amount of cyclo-olefin copolymer resin is less than 50% by weight, it is difficult to maintain adequate image density and so forth for a long period of time in any environment during continuous printing of a large number of sheets, while also tending to be difficult to provide a full-color toner for oil-less fixing that is free of the occurrence of problems of BS on the photosensitive member and fusing of toner to the developing member.

Examples of other resins blended into the cyclo-olefin copolymer resin include polystyrene resin, polyacrylic acid ester resin, styrene-acrylic acid ester copolymer resin, styrene-methacrylic acid ester copolymer resin, polyvinyl chloride, polyvinyl acetate, polyvinylidene chloride, phenol resin, epoxy resin and polyester resin, and so forth, those resins of which the melting starting temperature (softening point) is as low as possible (e.g., 120–150° C.), are particularly preferable for the purpose of improving fixing property of the toner, and those having a high glass transition temperature of 65° C. or higher are preferable for improving storage stability.

The toner of the present invention is required to contain wax as a release agent at a total amount of 7.0–20% by weight, and more preferably 8.0–18% by weight, relative to the weight of a toner particle. In order to prevent filming caused by the wax, it is preferable that the wax be smallly dispersed in the binder resin at a diameter of 3 μm or less. If the total amount of the wax is less than 7.0% by weight, releasing effect is inadequate and offset occurs easily. In contrast, if the total amount of wax exceeds 20% by weight, the wax easily causes the occurrence of filming. In addition, wax also causes filming if the wax particle diameter exceeds 3 μm.

Examples of wax used in the present invention include polyolefin-based waxes such as polyethylene wax and polypropylene wax, synthetic waxes such as Fischer-Tropsch wax, petroleum-based waxes such as paraffin wax and microwax, carnauba wax, candelilla wax, rice wax, cured castor oil and so forth. In addition, modified polyethylene wax can also be used for the purpose of controlling the finely dispersing of wax in the cyclo-olefin copolymer resin. It is also preferable to use two or more of these waxes.

In the present invention, at least one of wax is preferably Fischer-Tropsch wax. Fischer-Tropsch wax has the effect of expanding the non-offset temperature range. In addition, among Fischer-Tropsch wax, natural gas based Fisher-Tropsch wax is more preferable.

The melting point as indicated by the endothermic peak of DSC of all wax is preferably 80° C. or higher. If under 80° C., problems with durability occur due to the increased susceptibility to the occurrence of blocking of the toner particles. In addition, the melting point of at least one wax is preferably 100° C. or lower. If the melting point of all waxes is high in excess of 100° C., it becomes difficult to exhibit releasing properties at fixing, thereby resulting greater susceptibility to the occurrence of offset.

Examples of colorants used in the present invention include black pigments such as carbon black; magenta pigments such as C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209, C.I. pigment violet 19, and C.I. violet 1, 2, 10, 13, 15, 23, 29 and 35; cyan pigments such as C.I. pigment blue 2, 3, 15, 16 and 17, C.I. vat blue 6 and C.I. acid blue 45; and yellow pigments such as C.I. pigment yellow 1, 2, 3, 4, 5, 6, 7, 10, 11, 12, 13, 14, 15, 16, 17, 23, 65, 73, 74, 83, 93, 97, 128, 155 and 180, and these can be used alone or as a mixture. Preferable examples for full-color toner include magenta pigments such as C.I. pigment red 57 and 122, cyan pigments such as C.I. pigment blue 15, and yellow pigments such as C.I. pigment yellow 17, 93, 155 and 180 since these have satisfactory color mixing property and so superior color reproduction property. The colorant is required to be present at a ratio that is sufficient for the forming of visible images of sufficient density, and is contained at, for example, a ratio of about 1–20 parts by weight relative to 100 parts by weight of toner particles, and preferably at 3.0–8.0% by weight. If the amount of colorant exceeds 8.0% by weight, the transparency of the printed images decreases, and if it is less than 3.0% by weight, sufficient image density is unable to be obtained. In addition, it is preferable to use a master batch in which pigment is pre-dispersed at a high concentration in a resin that is able to function as a binder resin for the full-color toner in order to achieve better pigment dispersion.

The charge control agent in the present invention is added to impart polarity, and classified into an agent used for positive charge toners and an agent used for negative charge toners. Examples of charge control agents used for positive charge toners include nigrosine dyes, quaternary ammonium salts, pyridinium salts, azines and so forth. In addition, examples of charge control agents used for negative charge toners include azo-based metal complexes, salicylic acid-based metal complexes and compounds having the general formula indicated below. The preferable amount of charge control agent blended is 0.1–5.0 parts by weight relative to 100 parts by weight of toner particles. In the present invention, with the exception of black toner, it is necessary that the charge control agent shall be colorless or lightly colored. If the amount of charge control agent is less than 0.1 parts by weight, charging property becomes inadequate, while if the amount exceeds 5.0 parts by weight, charging stability becomes poor. A boron complex using B (boron) for the center, which is a compound of the following general formula, is used particularly preferably for the charge control agent of the present invention. This boron complex is particularly preferably blended at 1.0–4.0 parts by weight relative to the toner particles. Although salicylic acid-based zinc complexes and chromium complexes can also be used for color toners, in the case of using alone, there are cases in which they impair charging stability. This is presumed to be caused by the volume specific resistance of the cyclo-olefin copolymer resin being higher in comparison with polyester resin and so forth. Furthermore, the above charge control agents may be used alone or as a mixture.

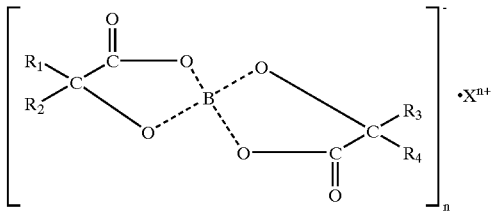

In the formula, $R_1$ and $R_4$ represent a hydrogen atom, alkyl group or substituted or non-substituted aromatic ring including a condensed ring, $R_2$ and $R_3$ represent a substituted or non-substituted aromatic ring also including a condensed ring, B represents boron, $X^{n+}$ represents a cation, and n is 1 or 2.

Another example of an additive that may be contained as necessary is magnetic powder. Specific examples of magnetic powders include fine particles of ferrite powder, magnetite powder, iron powder and so forth. A mixed sintered material of MeO—$Fe_2O_3$ is used in the present invention as ferrite powder. Examples of Me in this case include Mn, Zn, Ni, Ba, Co, Cu, Li, Mg, Cr, Ca and V, and one or two or more are used. In addition, a mixed sintered material of FeO—$Fe_2O_3$ is used as magnetite powder. The magnetic powder preferably has a particle diameter of 0.05–3 $\mu$m, and is preferably contained at 70% by weight or less relative to the toner.

The toner particles that compose the present invention are produced by mixing the above materials at prescribed ratios, and that mixture going through the steps of melt-kneading, pulverizing and classifying. In addition, toner particles may also be obtained by a polymerization method using the above materials.

In the toner of the present invention, 1.0–4.0% by weight of hydrophobic silica fine particles are preferably adhered to the toner particles. If the adhered amount of hydrophobic silica fine particles is less than 1.0% by weight, the release agent contained in the toner particles adheres to the photosensitive member and charging members resulting in increases susceptibility to the occurrence of image defects, fluidity of the toner decreases, and so supply of toner becomes insufficient and long-term storage stability of the toner becomes poor. If the adhered amount exceeds 4.0% by weight, separation of the hydrophobic silica occurs easily, thereby causing problems such as BS and background fogging. The amount of hydrophobic silica added is more preferably 1.5–3.5% by weight.

In addition, at least a combination of large particles having a volume average particle diameter of 0.03–0.10 $\mu$m and medium to small particles having a volume average particle diameter of 0.03 $\mu$m or less is preferably used for the hydrophobic silica fine particles. As a result, even more stable resistance to fusing can be obtained. If the volume average particle diameter of the large hydrophobic silica particles exceeds 0.10 $\mu$m, fluidity becomes poor. If the volume average particle diameter is less than 0.03 $\mu$m, adequate fusing resistance cannot be obtained. It is preferable that 0.5–3.0% by weight of large hydrophobic silica particles be adhered to the toner particles. In addition, if the amount of large hydrophobic silica particles exceeds 3.0% by weight, fluidity becomes poor, while if less than 0.5% by weight, fusing resistance becomes inadequate.

In addition to hydrophobic silica fine particles, external additives such as magnetic powder, alumina, talc, clay, calcium carbonate, magnesium carbonate, titanium oxide or various resin small particles may be adhered to the toner particles as necessary to control toner fluidity, charging properties, cleaning properties, storage properties and so forth.

Methods for adhering the above fine particles to the toner particles include an agitation method by mixing using an ordinary agitator such as a turbine agitator, Henschel mixer, super mixer and so forth.

The following provides an explanation of the present invention based on its examples and comparative examples. However, the present invention is not limited to these.

To begin with, the following toners A through G were produced.

EXAMPLE 1

Production of Toner A

| | |
|---|---|
| Cyclo-olefin copolymer resin (marketed by Ticona GmbH, trade name: TOPAS COC, type in which residual solvent decalin has been sufficiently removed, high molecular weight resin blended into low molecular weight resin) | 76.0 parts by weight |
| Polypropylene wax (marketed by Sanyo Chemical Industries Ltd., trade name: VISCOLL 660P, melting point: 135° C.) | 5.0 parts by weight |
| Carnauba wax (marketed by S. KATO & CO., trade name: CARNAUBA NO. 2 POWDER, melting point: 82° C.) | 5.0 parts by weight |
| Boron complex (marketed by Japan Carlit Co., Ltd., trade name: LR-147) | 2.0 parts by weight |
| Quinacridone pigment master batch (Pigment: polyolefin resin = 7:3, Pigment: marketed by Clariant (Japan) K.K., trade name: TONER MAGENTA E02 = C.I. pigment red 122) | 12.0 parts by weight |

Raw material comprised of the above blending ratio was mixed with a super mixer and after heat melt kneading with a twin-screw extruder, the mixture was pulverized with a jet mill followed by classifying with a dry air classifier to obtain toner particles having a volume average particle diameter of 9 μm.

1.0% by weight of large hydrophobic silica (marketed by Nippon Aerosil Co., Ltd., trade name: RY-50, volume average particle diameter: 0.05 μm) and 1.0% by weight of medium hydrophobic silica (marketed by CABOT Specialty Chemicals Inc., trade name: TG-308F, volume average particle diameter: 0.01 μm) were added to the toner particles followed by mixing for 4 minutes at circumference rate of 40 m/sec with a Henschel mixer to obtain Toner A. The Mn of Toner A was 4,100, Mw was 14,000 and Mw/Mn was 3.41. The residual concentration of decalin in the toner particles was 254 ppm.

EXAMPLE 2

Production of Toner B

With the exception of making the blended amounts of wax 9.0 parts by weight of polypropylene wax and 9.0 parts by weight of carnauba wax, and using 68 parts by weight of cyclo-olefin copolymer resin, magenta toner was obtained in the same manner as Example 1.

EXAMPLE 3

Production of Toner C

With the exception of making the blended amounts of wax 4.0 parts by weight of polypropylene wax and 4.0 parts by weight of carnauba wax, and using 78 parts by weight of cyclo-olefin copolymer resin, magenta toner was obtained in the same manner as Example 1.

EXAMPLE 4

Production of Toner D

With the exception of adding 0.6% by weight of large hydrophobic silica (marketed by Nippon Aerosil Co., Ltd., trade name: RY-50, volume average particle diameter: 0.05 μm) and 0.6% by weight of medium hydrophobic silica (marketed by CABOT Specialty Chemicals Inc., trade name: TG-308F, volume average particle diameter: 0.01 μm), magenta toner was obtained in the same manner as Example 1.

EXAMPLE 5

Production of Toner E

With the exception of adding 2.0% by weight of large hydrophobic silica (marketed by Nippon Aerosil Co., Ltd., trade name: RY-50, volume average particle diameter: 0.05 μm) and 2.0% by weight of medium hydrophobic silica (marketed by CABOT Specialty Chemicals Inc., trade name: TG-308F, volume average particle diameter: 0.01 μm), magenta toner was obtained in the same manner as Example 1.

EXAMPLE 6

Production of Toner F

With the exception of changing the blending ratio of cyclo-olefin copolymer resin, making the Mn of the toner particles 3,500 and the Mw 9,800 so that the Mw/Mn ratio was 2.80, and making the residual concentration of decalin in the toner 231 ppm, magenta toner was obtained in the same manner as Example 1.

EXAMPLE 7

Production of Toner G

With the exception of changing the blending ratio of cyclo-olefin copolymer resin, making the Mn of the toner particles 4,500 and the Mw 58,000 so that the Mw/Mn ratio was 12.9, and making the residual concentration of decalin in the toner 345 ppm, magenta toner was obtained in the same manner as Example 1.

EXAMPLE 8

Production of Toner H

With the exception of making the blended amounts of wax 1.0 part by weight of natural gas based Fischer-Tropsch wax (marketed by Nippon Seiro Co., LTD., trade name: FT-100, melting point: 93° C.), 4.0 parts by weight of carnauba wax and 4.0 parts by weight of polypropylene wax, and using 77 parts by weight of cyclo-olefin copolymer resin, magenta toner was obtained in the same manner as Example 1.

EXAMPLE 9

Production of Toner I

With the exception of making the blended amount of boron complex of the charge control agent 1.0 part by weight, and using 77 parts by weight of cyclo-olefin copolymer resin, magenta toner was obtained in the same manner as Example 1.

EXAMPLE 10

Production of Toner J

With the exception of making the blended amount of boron complex of the charge control agent 4.0 parts by weight, and using 74 parts by weight of cyclo-olefin copolymer resin, magenta toner was obtained in the same manner as Example 1.

EXAMPLE 11

Production of Toner K

With the exception of using a resin for which the solvent removal step was simplified during production of cyclo-olefin copolymer resin, magenta toner was obtained in the same manner as Example 1. The residual concentration of decalin in this toner was 480 ppm.

Comparative Example 1

Production of Toner L

With the exception of making the blended amounts of wax 2.5 parts by weight of polypropylene wax and 2.5 parts by weight of carnauba wax, and using 81 parts by weight of cyclo-olefin copolymer resin, magenta toner was obtained for comparison in the same manner as Example 1.

Comparative Example 2

Production of Toner M

With the exception of making the blended amounts of wax 12.5 parts by weight of polypropylene wax and 12.5 parts by weight of carnauba wax, and using 61 parts by weight of cyclo-olefin copolymer resin, magenta toner was obtained for comparison in the same manner as Example 1.

Comparative Example 3

Production of Toner N

With the exception of using polyester resin for the binder resin, magenta toner was obtained for comparison in the same manner as Example 1. The Mn of the resulting Toner N was 3,800, Mw was 18,000, and Mw/Mn was 4.73.

Comparative Example 4

Production of Toner O

With the exception of changing the blending ratio of cyclo-olefin copolymer resin, magenta toner was obtained for comparison in the same manner as Example 1. The Mn of the resulting toner was 4,500, Mw was 70,000, and Mw/Mn was 15.6.

Comparative Example 5

Production of Toner P

With the exception of adhering 2.5 parts by weight of large hydrophobic silica and 1.0 parts by weight of medium hydrophobic silica for a total of 3.5 parts by weight of adhered hydrophobic silica, magenta toner was obtained for comparison in the same manner as Example 1.

Each of the above Toners A through P were put into the developing device of the MICROLINE 3020C full-color printer of Oki Electric Industry Co., Ltd. followed by copying up to 10,000 sheets of an A4 manuscript having an image ratio of 5% onto A4-size commercially available PPC paper and evaluation of each of the toners of Examples 1 through 11 and Comparative Examples 1 through 5. Evaluations were carried out under environmental conditions of normal temperature and normal humidity (N/N: 20° C., 58% RH), high temperature and high humidity (H/H: 32° C., 85% RH) and low temperature and low humidity (L/L: 10° C., 20% RH).

The toner production conditions are shown in Table 1, while the evaluation results are shown in Table 2. Furthermore, carnauba wax is abbreviated as carnauba in Table 1.

The evaluation methods were as described below.

1. Image density (ID) was evaluated by measuring a solid image portion with the RD-914 MacBeth reflection densitometer.
2. Background fogging (BG) was evaluated by measuring the whiteness of a non-image portion with the ZE2000 Color Meter made by Nippon Denshoku Industries, Ltd., and indicating as the difference in whiteness before and after copying.
3. Offset was evaluated by visually confirming the fixing device and image. ○ indicates no occurrence of offset, Δ indicates slight contamination of the fixing roller, Δx indicates slight contamination of the imaging face or back face, and x indicates definite occurrence of offset on the imaging face.
4. BS and fusing were evaluated by visually confirming the photosensitive member, developing roller and layer thickness regulating plate. ○ indicates no occurrence of BS and fusing, Δ indicates slight streaks confirmed on the developing roller, Δx indicates definite streaks confirmed on the developing roller or slight BS confirmed on the photosensitive member, and x indicates image defects by fusing or BS confirmed on the imaging face.
5. Glossiness was evaluated by printing a solid image adjusted to an adhered amount of about 1.0 mg/cm$^2$ with a two-component copier from which the fixing device had been removed fixing the image by an external fixing device, and taking the average of three times measurements of 75° specular glossiness of a printed image face of a sample using the Gloss Meter (VGS-SENSOR) made by Nippon Denshoku Industries, Ltd.

TABLE 1

| | | | Wax content | | | Amount of hydrophobic silica | | Toner molecular weight | | | Amount of charge control | Residual decalin |
|---|---|---|---|---|---|---|---|---|---|---|---|---|
| | Toner | Binder resin | PP | Carnauba | FT-100 | Large | Medium | Mn | Mw | Mw/Mn | agent | conc. |
| Ex. 1 | A | Cyclo-olefin copolymer | 5.0 | 5.0 | — | 1.0 | 1.0 | 4,100 | 14,000 | 3.41 | 2.0 | 254 |
| Ex. 2 | B | ↑ | 9.0 | 9.0 | — | ↑ | ↑ | ↑ | ↑ | ↑ | ↑ | 215 |
| Ex. 3 | C | ↑ | 4.0 | 4.0 | — | ↑ | ↑ | ↑ | ↑ | ↑ | ↑ | 266 |
| Ex. 4 | D | ↑ | 5.0 | 5.0 | — | 0.6 | 0.6 | ↑ | ↑ | ↑ | ↑ | 254 |
| Ex. 5 | E | ↑ | ↑ | ↑ | — | 2.0 | 2.0 | ↑ | ↑ | ↑ | ↑ | ↑ |
| Ex. 6 | F | ↑ | ↑ | ↑ | — | 1.0 | 1.0 | 3,500 | 9,800 | 2.80 | ↑ | 231 |
| Ex. 7 | G | ↑ | ↑ | ↑ | — | ↑ | ↑ | 4,500 | 58,000 | 12.9 | ↑ | 345 |

TABLE 1-continued

| | Toner | Binder resin | Wax content | | | Amount of hydrophobic silica | | Toner molecular weight | | | Amount of charge control agent | Residual decalin conc. |
|---|---|---|---|---|---|---|---|---|---|---|---|---|
| | | | PP | Carnauba | FT-100 | Large | Medium | Mn | Mw | Mw/Mn | | |
| Ex. 8 | H | ↑ | 4.0 | 4.0 | 1.0 | ↑ | ↑ | 4,100 | 14,000 | 3.41 | ↑ | 254 |
| Ex. 9 | I | ↑ | 5.0 | 5.0 | — | ↑ | ↑ | ↑ | ↑ | ↑ | 1.0 | ↑ |
| Ex. 10 | J | ↑ | ↑ | ↑ | — | ↑ | ↑ | ↑ | ↑ | ↑ | 4.0 | ↑ |
| Ex. 11 | K | ↑ | ↑ | ↑ | — | ↑ | ↑ | ↑ | ↑ | ↑ | 2.0 | 480 |
| Com. Ex. 1 | L | Cyclo-olefin copolymer | 2.5 | 2.5 | — | 1.0 | 1.0 | 4,100 | 14,000 | 3.41 | 2.0 | 293 |
| Com. Ex. 2 | M | ↑ | 12.5 | 12.5 | — | ↑ | ↑ | ↑ | ↑ | ↑ | ↑ | 203 |
| Com. Ex. 3 | N | Polyester | 5.0 | 5.0 | — | ↑ | ↑ | 3,800 | 18,000 | 4.73 | ↑ | 0 |
| Com. Ex. 4 | O | Cyclo-olefin copolymer | ↑ | ↑ | — | ↑ | ↑ | 4,500 | 70,000 | 15.6 | ↑ | 406 |
| Com. Ex. 5 | P | ↑ | ↑ | ↑ | — | 2.5 | ↑ | 4,100 | 14,000 | 3.41 | ↑ | 254 |

TABLE 2-1

| | Toner used | Glossiness | Initial | | | After 10000 sheets N/N | | | |
|---|---|---|---|---|---|---|---|---|---|
| | | | ID | BG | Offset | ID | BG | Offset | Fusing · BS |
| Ex. 1 | A | 30.8 | 1.42 | 0.65 | ○ | 1.45 | 0.56 | ○ | ○ |
| Ex. 2 | B | 37.5 | 1.52 | 0.55 | ○ | 1.58 | 0.49 | ○ | ○ |
| Ex. 3 | C | 25.4 | 1.36 | 0.63 | ○ | 1.39 | 0.60 | ○ | ○ |
| Ex. 4 | D | 32.6 | 1.42 | 0.66 | ○ | 1.47 | 0.59 | ○ | ○ |
| Ex. 5 | E | 20.5 | 1.35 | 0.50 | ○ | 1.40 | 0.63 | ○ | ○ |
| Ex. 6 | F | 40.7 | 1.62 | 0.66 | ○ | 1.67 | 0.61 | ○ | ○ |
| Ex. 7 | G | 15.2 | 1.30 | 0.52 | ○ | 1.33 | 0.48 | ○ | ○ |
| Ex. 8 | H | 31.0 | 1.41 | 0.33 | ○ | 1.47 | 0.35 | ○ | ○ |
| Ex. 9 | I | 29.4 | 1.51 | 0.74 | ○ | 1.53 | 0.78 | ○ | ○ |
| Ex. 10 | J | 30.1 | 1.37 | 0.44 | ○ | 1.40 | 0.49 | ○ | ○ |
| Ex. 11 | K | 28.3 | 1.41 | 0.77 | ○ | 1.43 | 0.83 | ○ | ○ |
| Com. Ex. 1 | L | 19.9 | 1.43 | 0.62 | ○ | 1.35 | 0.55 | Δ | ○ |
| Com. Ex. 2 | M | 35.2 | 1.44 | 0.63 | ○ | 1.33 | 0.51 | ○ | Δ |
| Com. Ex. 3 | N | 28.8 | 1.46 | 0.59 | ○ | 1.39 | 0.55 | ○ | Δ |
| Com. Ex. 4 | O | 10.3 | 1.40 | 0.58 | ○ | 1.43 | 0.62 | ○ | ○ |
| Com. Ex. 5 | P | 12.7 | 1.25 | 0.41 | ○ | 1.28 | 0.53 | ○ | ○ |

TABLE 2-2

| | After 10000 sheets L/L | | | | After 10000 sheets H/H | | | |
|---|---|---|---|---|---|---|---|---|
| | ID | BG | Offset | Fusing · BS | ID | BG | Offset | Fusing · BS |
| Ex. 1 | 1.41 | 0.45 | ○ | ○ | 1.47 | 0.73 | ○ | ○ |
| Ex. 2 | 1.46 | 0.50 | ○ | ○ | 1.56 | 0.50 | ○ | ○ |
| Ex. 3 | 1.35 | 0.54 | ○ | ○ | 1.46 | 0.69 | ○ | ○ |
| Ex. 4 | 1.38 | 0.47 | ○ | ○ | 1.49 | 0.77 | ○ | ○ |
| Ex. 5 | 1.30 | 0.61 | ○ | ○ | 1.41 | 0.75 | ○ | ○ |
| Ex. 6 | 1.58 | 0.55 | ○ | ○ | 1.71 | 0.76 | ○ | ○ |
| Ex. 7 | 1.27 | 0.44 | ○ | ○ | 1.36 | 0.65 | ○ | ○ |
| Ex. 8 | 1.36 | 0.29 | ○ | ○ | 1.45 | 0.37 | ○ | ○ |
| Ex. 9 | 1.50 | 0.71 | ○ | ○ | 1.58 | 0.86 | ○ | ○ |
| Ex. 10 | 1.34 | 0.38 | ○ | ○ | 1.40 | 0.53 | ○ | ○ |
| Ex. 11 | 1.37 | 0.72 | ○ | ○ | 1.45 | 0.86 | ○ | ○ |
| Com. Ex. 1 | 1.38 | 0.46 | Δ | ○ | 1.38 | 0.68 | Δx | ○ |
| Com. Ex. 2 | 1.34 | 0.47 | ○ | Δ | 1.28 | 0.44 | ○ | Δx |
| Com. Ex. 3 | 1.40 | 0.50 | ○ | Δ | 1.30 | 1.21 | ○ | Δx |
| Com. Ex. 4 | 1.44 | 0.49 | ○ | ○ | 1.44 | 0.73 | ○ | ○ |
| Com. Ex. 5 | 1.21 | 0.45 | Δ | ○ | 1.29 | 0.66 | ○ | ○ |

As is clear from Table 2, in the case of the toners of the present invention of Examples 1 through 11, initial image density and that after 10,000 sheets printed in each environment shown were 1.27 or more, background fogging was 0.86 or less, and copying was able to be carried out over a range that did not present any practical problems. Moreover, there were also confirmed to be no problems with charging property, fixing property and durability, and there was no occurrence of offset, BS on the photosensitive member or fusing to the developing members. Glossiness of a printed image face was 15 or more, and the images were of high image quality. In addition, similar results were obtained for yellow, cyan and black, confirming the toners to be suitable for use as full-color toner.

In contrast, in the case of the comparative toners of Comparative Examples 1 through 3, there were various problems confirmed for charging property, fixing property and durability, that is, problems of image density, background fogging, offset, occurrence of BS on the photosensitive member and fusing to developing members. The comparative toners of Comparative Examples 4 and 5 exhibited glossiness of less than 15, had inferior image quality and were unsuitable for use as full-color toner.

What is claimed is:

1. A full-color toner for oil-less fixing comprising a cyclo-olefin copolymer resin as a binder resin and a wax or waxes added as a release agent at the total weight of 7.0–20% by weight relative to the weight of a toner particle, and having 15 or more of glossiness of a printed image face, wherein the concentration of decalin contained in the toner particles is 500 ppm or less by weight relative to the weight of the toner particle.

2. A full-color toner for oil-less fixing according to claim 1, wherein hydrophobic silica fine particles are adhered to the surface of the toner particles at 1.0–4.0% by weight relative to the total weight of the toner particles.

3. A full-color toner for oil-less fixing according to claim 2, wherein said hydrophobic silica fine particles are composed of large particles having a volume average particle diameter of 0.03–0.10 $\mu$m and medium and small particles having a volume average particle diameter of less than 0.03 $\mu$m.

4. A full-color toner for oil-less fixing according to claim 1, wherein said cyclo-olefin copolymer resin as a binder resin in the toner has a number average molecular weight (Mn) of 3,000–6,000 as measured by GPC, a weight average molecular weight (Mw) of 9,000–60,000, and the ratio of Mw/Mn is 2.0–15.

5. A full-color toner for oil-less fixing according to claim 1, wherein at least one wax has a melting point which is indicated with the endothermic peak of DSC of 80–1000° C.

6. A full-color toner for oil-less fixing according to claim 5, wherein said at least one wax is Fischer-Tropsch wax.

7. A full-color toner for oil-less fixing according to claim 1, wherein a compound represented by the following general formula is contained as a charge control agent at 1.0–4.0% by weight relative to the weight of a toner particle:

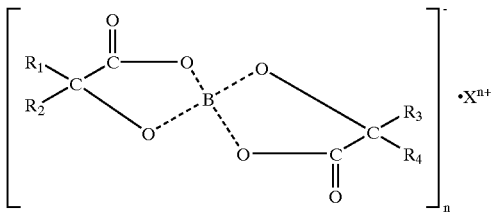

wherein $R_1$ and $R_4$ represent a hydrogen atom, alkyl group or substituted or non-substituted aromatic ring including a condensed ring, $R_2$ and $R_3$ represent a substituted or non-substituted aromatic ring also including a condensed ring, B represents boron, $X^{n+}$represents a cation, and n is 1 or 2.

8. A full-color toner for oil-less fixing according to claim 5, wherein said at least one wax is carnauba wax.

9. A full-color toner for oil-less fixing according to claim 1, wherein said wax is polyolefin-based wax.

10. A full-color toner for oil-less fixing according to claim 9, wherein said polyolefin-based wax is polypropylene wax.

11. A full-color toner for oil-less fixing according to claim 1, wherein said waxes are at least carnauba wax and polypropylene wax.

12. A full-color toner for oil-less fixing according to claim 1, wherein said waxes are at least Fischer-Tropsch wax and polypropylene wax.

* * * * *

UNITED STATES PATENT AND TRADEMARK OFFICE

CERTIFICATE OF CORRECTION

PATENT NO. : 6,846,602 B2
DATED : January 25, 2005
INVENTOR(S) : Yoshihito Suwa et al.

It is certified that error appears in the above-identified patent and that said Letters Patent is hereby corrected as shown below:

Column 16,
Line 7, "80-1000°C." should read -- 80-100°C. --

Signed and Sealed this

Twenty-fourth Day of May, 2005

JON W. DUDAS
*Director of the United States Patent and Trademark Office*